United States Patent [19]

Jurak

[11] 3,967,417

[45] July 6, 1976

[54] SANDING DEVICES

[76] Inventor: Ivan Jurak, Am Feldrand 8, Niefern, Germany

[22] Filed: Mar. 27, 1975

[21] Appl. No.: 562,483

[30] Foreign Application Priority Data

Mar. 29, 1974 Germany ..... 7411062[U]

[52] U.S. Cl. ..... 51/170 TL; 51/170 MT

[51] Int. Cl.[2] ..... B24B 23/00

[58] Field of Search ..... 51/170 TL, 170 MT; 74/87

[56] References Cited

UNITED STATES PATENTS

| | | | |
|---|---|---|---|
| 2,957,282 | 10/1960 | Swanson | 51/170 TL |
| 3,283,352 | 11/1966 | Ho | 51/170 MT |
| 3,657,844 | 4/1972 | Mogaki | 51/170 MT |
| 3,755,972 | 9/1973 | Mogaki et al. | 51/170 MT |

FOREIGN PATENTS OR APPLICATIONS

| | | | |
|---|---|---|---|
| 684,961 | 12/1952 | United Kingdom | 51/170 TL |

*Primary Examiner*—James L. Jones, Jr.

[57] ABSTRACT

An oscillating sanding device includes a casing to be held in the hand and a sanding table supported below the casing by resilient columns. The sanding table includes a cylindrical ring within which fits a rotor smaller than the ring and mounted to turn within the ring. The rotor is unbalanced and is provided with projecting blades through which it can be driven by pressure fluid supplied through a valve in the casing. The valve can be opened by a pushbutton located on top of the casing.

7 Claims, 4 Drawing Figures

SANDING DEVICES

BACKGROUND OF THE INVENTION

1. Field of the Invention

The invention relates to oscillating sanding devices having a driving unit which is pneumatically controlled through a valve system and causes the work-plate or sanding table to perform reciprocating oscillatory or vibratory motions.

2. The Prior Art

It has already been proposed to use oscillating sanding devices of this kind for precision sanding or finishing, especially wet-sanding, because their very high vibratory frequency combined with a relatively low amplitude of oscillation makes these devices highly suitable for precision work. However, known systems of comparable construction are only suitable for finishing processes and are liable to excessive wear of the working parts. This accounts for the fact that their output tends to decrease very rapidly. It is an object of the present invention to provide an improved oscillating sanding machine of the kind referred to above.

According to the invention, this object is achieved by the provision of a sanding device of the above discussed type wherein the driving unit incorporates an unbalanced rotor which is pivoted on the work-plate or sanding table and, in consequence of its unbalance, causes the sanding plate which is resiliently suspended from the casing of the oscillating sanding device, to perform reciprocating oscillations.

The basic concept of the invention is founded on the provision of a relatively large-sized drive for the work-plate or sanding plate, which is supported inside a casing which is connected with the work table or sanding table. It is advantageous to support the rotor in a recess in the sanding plate, and to give the latter the additional function of a casing for the drive unit. With this arrangement, the design is extremely simple, the cost is moderate, and the efficiency is increased, losses of drive-energy being extremely small.

In addition, the use of resilient elements between the sanding plate and the main body of the vibratory sander to which it is attached, has been found to be advantageous. Also, a valve system, located in the main body of the vibratory sanding device, and incorporating a tappet with a push-button which interacts with a lever attached to a valve member and enables the latter to be tilted relative to the valve seat, is preferably provided.

BRIEF DESCRIPTION OF THE DRAWINGS

Further details and advantages of the invention are discussed below in the light of the accompanying drawings which show, by way of example only, one embodiment of the invention. In the drawings.

DESCRIPTION OF THE PREFERRED EMBODIMENTS

Figure 1:
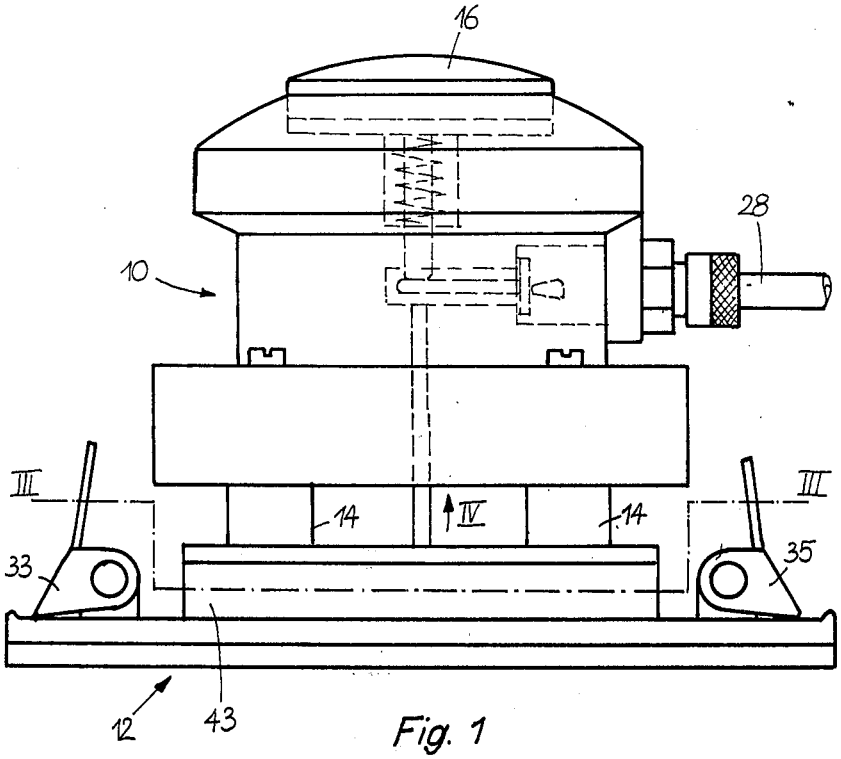
FIG. 1 shows a vibratory sanding device according to the invention in schematic elevation.

The vibratory sanding device according to FIG. 1 consists of a main body or casing 10, and a sanding plate 12, connected with the casing through resilient elements 14, the sanding plate also serving as a work-plate. The main body 10 of the vibratory sanding device incorporates a valve system which is shown in greater detail in FIG. 2.

Figure 2:
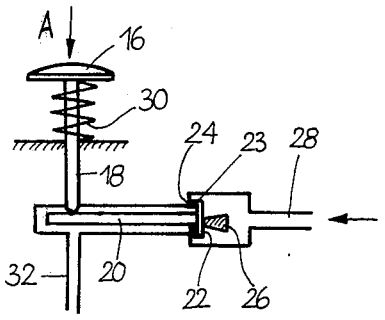
FIG. 2 shows a valve system forming part of the vibratory sanding device according to FIG. 1.
Figure 4:
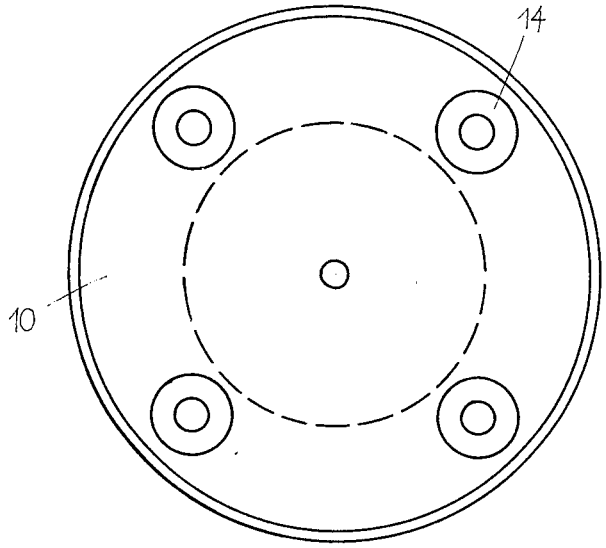
FIG. 4 shows the casing of the vibratory sanding device according to FIG. 1 seen from below in the direction of the arrow IV in FIG. 1.

As shown in FIG. 2, the valve system consists of a push button 16 which is accessible from the upper side of the main body or casing 10 of the vibratory sanding device. A tappet 18, integral with or otherwise connected to the push button 16 extends into the interior of the main body or casing 10 of the vibratory sanding device and interacts with one end of a lever 20, the other end of which carries a valve disc 22 which, in turn, carries on its underside a packing 23 and interacts with a valve seat 24.

The face of the valve disc 22 which is remote from the lever 20 is provided with a locking element 26 which anchors the valve disc 22 in relation to the valve seat 24. The side of the valve disc 22 which is remote from the lever 20 may be subjected to compressed air through a connection 28. In the case of the vibratory sanding device shown in FIG. 1 this comprises a compressed air hose connected with the main body 10. With the push button 16 in the position according to FIG. 2, compressed air admitted through the compressed air pipe 28 forces the valve disc 22 to press firmly against the valve seat 24. Therefore, the driving unit in the sanding plate 12 (which is not shown in the drawings) is not supplied with compressed air. When the push button 16 is moved downwards against the force of a coil spring 30 around the tappet 18, that is to say, in the direction of arrow A in FIG. 2, the lever 20 tilts the valve disc 22 so that part of its circumference is lifted off the valve seat 24, and compressed air is admitted to the driving unit through a feed pipe 32.

Figure 3:
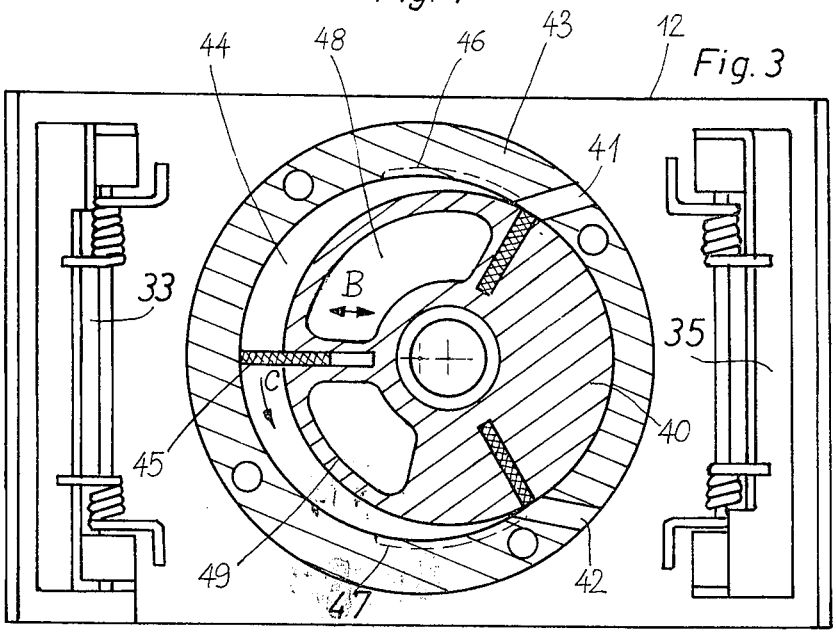
FIG. 3 shows a section of the vibratory sanding device of FIG. 1 on the line III—III in FIG. 1.

To make the rotor 40 of the driving unit rotate (FIG. 3) compressed air is admitted through the feed pipe 32 and an inlet 41 into a gap 44 inside the casing 43, and acts against vane or blade-like elements which slide forwards and back in slots in the rotor as indicated by arrow B, and consequently cause the rotor to rotate in the direction of the arrow C. The compressed air leaves through an outlet 42.

Two by-pass ducts 46 and 47 extend from the inlet and towards the outlet respectively. The recesses 48, 49, serve as a means by which to create an unbalance at the rotor. The rotor casing 43 is fixed to the work-plate 12 whereby this work-plate or sanding table 12, affected by the unbalance of the rotor, is caused to vibrate, its oscillations corresponding to the rotational speed of the rotor. This vibratory movement is permitted by the resilient members 14 through which the rotor casing and therefore also the work-head or sanding head 12 is connected with the main body 10 of the vibratory sanding device. In this way only a very small proportion of the vibratory movements are transmitted to the main body 10. This means that the vibrations of the sanding head 12 are practically unrestrictedly available for the sanding process, especially when the main body 10 of the vibratory sanding device is designed as an appropriately heavy component. The work-table or sanding table in fact constitutes the casing for the drive unit which revolves, under unbalance, around a rotational axis which extends at right angles to the work-table.

If desired the rotor of the drive unit could be differently designed, and a pneumatic, or hydraulic drive could be used. There are not restrictions with regard to the design of rotors for individual cases, provided that the rotor comprises an unbalance device which satisfies the demands and provided that the unbalance of the rotor is capable of causing the work-table or sanding table, which is suspended from the casing in a resilient manner, to vibrate. The casing 10 can be equipped with hand-grips so that the complete unit may be used as a portable device. Finally, provision has been made in the form of appliances 33, 35, to attach sand paper to the underside of the work-table or sanding plate 12 in a known manner.

Having thus described my invention, what I claim and desire to secure by Letters Patent is:

1. An oscillating sanding device comprising a casing, a sanding table, means resiliently connecting the sanding table to the casing, an unbalanced rotor carried by and rotatable with respect to the sanding table, means operatively connecting the rotor to the sanding table in impart to the sanding table vibrations imparted to the rotor by rotation thereof in consequence of such unbalance, and valve controlled fluid pressure means operatively connected to the rotor to produce rotation thereof.

2. An oscillating sanding device according to claim 1, wherein the rotor is rotatable about an axis perpendicular to the plane of the sanding table.

3. An oscillating sanding device according to claim 1, in which the sanding table has means forming a recess therein and the rotor is located within the recess and is of smaller outer dimensions than the inner dimension of the recess.

4. An oscillating sanding device according to claim 3, in which the rotor is a flat cylinder element.

5. An oscillating sanding device according to claim 1, in which the rotor is provided with asymmetrically located recesses therein to provide unbalance.

6. An oscillating sanding device according to claim 1, in which the resilient connecting means comprises elastic columns whose longitudinal axes extend approximately parallel to the axis of rotation of the rotor.

7. An oscillating sanding device according to claim 1, in which said valve control means includes a valve system housed inside the casing and comprises a valve seat, a tappet having a part cooperating with the valve seat and a stem extending from such part, and a push-button operatively engaging with the stem for tilting the valve disc relative to the valve seat.

* * * * *